US006280528B1

(12) United States Patent
Kharshan et al.

(10) Patent No.: US 6,280,528 B1
(45) Date of Patent: Aug. 28, 2001

(54) WATER SOLUBLE CONTAINERS FOR BLENDS OF SURFACE CLEANERS AND CORROSION INHIBITORS

(75) Inventors: Margarita Kharshan, Little Canada; Boris A. Miksic, North Oaks; Clifford Cracauer III, St. Paul; Michael Hobday, Lino Lakes, all of MN (US)

(73) Assignee: Cortec Corporation, St. Paul, MN (US)

( * ) Notice: Subject to any disclaimer, the term of this patent is extended or adjusted under 35 U.S.C. 154(b) by 0 days.

(21) Appl. No.: 09/741,508

(22) Filed: Dec. 19, 2000

(51) Int. Cl.[7] ..... G23G 1/00

(52) U.S. Cl. ..... 134/3; 134/2; 134/6; 134/7; 134/36; 134/41; 134/42; 148/254; 510/245; 510/296; 206/0.5; 206/524.1; 206/524.5; 206/524.4; 206/524.7

(58) Field of Search ..... 134/2, 3, 6, 7, 134/36, 41, 42; 148/254; 510/296, 245; 206/524.7, 524.4, 524.5, 524.1, 0.5

(56) References Cited

U.S. PATENT DOCUMENTS 4,275,835 * 6/1981 Miksic et al. ..... 239/60
4,973,416 * 11/1990 Kennedy ..... 252/90
5,332,525 * 7/1994 Miksic et al. ..... 252/389.54
5,344,589 * 9/1994 Miksic et al. ..... 252/392
5,854,145 * 12/1998 Chandler et al. ..... 442/59
6,037,319 * 3/2000 Dickler et al. ..... 510/439
6,085,905 7/2000 Miksic et al. .
6,136,776 * 10/2000 Dickler et al. ..... 510/439
6,156,929 * 12/2000 Chandler et al. ..... 562/582

FOREIGN PATENT DOCUMENTS

0878564 A1 * 11/1998 (EP) .

* cited by examiner

*Primary Examiner*—Sharidan Carrillo
(74) *Attorney, Agent, or Firm*—Haugen Law Firm PLLP

(57) ABSTRACT

An improved method and/or process for preparing and handling formulations useful in metal treatment baths which includes packaging formulations useful in preparing and/or replenishing aqueous-based baths in water soluble pouches or containers. The present invention includes the selection of components effective in treating metallic surfaces, which may be blended and effectively stored in containers or pouches consisting of polyvinylalcohol film. The present invention reduces the necessity or frequency of personal hand contact by workers with these blends.

2 Claims, No Drawings

WATER SOLUBLE CONTAINERS FOR BLENDS OF SURFACE CLEANERS AND CORROSION INHIBITORS

BACKGROUND OF THE INVENTION

The present invention relates generally to an improved method and/or process for preparing and handling formulations useful in metal treatment baths, and more particularly to a method for preparing and packaging formulations useful in the preparation and replenishing of aqueous-based baths for simultaneously removing soil, grease and oils from metallic surfaces, while at the same time protecting these surfaces against corrosion. The present invention finds particular application in connection with products requiring short and/or intermediate term protection of their metallic surfaces as they are either shipped, stored or otherwise handled while awaiting further operations. Of particular interest is the protection of metallic surfaces of objects such as components, subassemblies and/or weldments which are partially completed in one production operation, and which must await transfer, shipment, and/or other indeterminate storage pending completion of the next operation.

The present invention involves an improved method or process for preparing working solutions of surface treating compounds by pre-blending surface cleaner and corrosion inhibitor components and packaging the resulting blends in water soluble pouches or containers. The method involves packaging water soluble vapor phase corrosion inhibiting chemicals (VCI) in combination with surface cleaners and/or detergents in water soluble pouches or containers so as to permit the addition of these components to baths without the necessity of hand involvement at this step of the process. The water soluble pouches or containers are preferably prepared from polyvinylalcohol (PVA) films, with the highly effective blends of surface cleaner and corrosion inhibiting components being compatible with PVA films, thus providing a significant shelf life for the pouches containing the components to be used in the working solutions.

In manufacturing and/or product processing operations, it has become common practice to manufacture certain components at a first facility or at a first location within a given facility, with the partially completed components being stored and/or held until needed for use in subsequent operations. An example of such a procedure would include a first operation for preparing a formed or configured component, with the component being held in inventory until needed for use and/or treatment in a subsequent operation. The subsequent operation may, for example, be to combine the component with a second component and then undergo the application of a surface coating for the combination. Because of the tendency of certain metallic surfaces to oxidize and/or corrode in the atmosphere, the application of a corrosion inhibitor to the surface is frequently undertaken to retard and/or prevent the creation of oxide layers and/or rust. Thus, in accordance with the present invention, parts prepared at one point in time for use at a later point in time may be cleaned and protected from corrosion and/or rust by treatment in a bath containing a blend of surface cleaners and corrosion inhibitors, with the working solution for the bath being prepared and replenished by the addition of surface cleaners and corrosion inhibitors blended in predetermined proportions and packaged in known quantities in water soluble pouches or containers. The components comprising the working solution may be maintained at their required concentration levels within the bath on an expeditious, effective and safe condition with the water soluble containers that can be added directly to the working solutions.

SUMMARY OF THE INVENTION

The present invention enables the straightforward, simple, and labor-saving method of preparing and replenishing working solutions for protecting metallic surfaces, with the method enabling the addition of cleaning and corrosion inhibiting components directly to the bath with the water soluble containers. Accordingly, the surface cleaning and corrosion inhibiting components for the working solution are initially selected to form a blend compatible with polyvinylalcohol (PVA) films. These selected components are then blended and loaded into the water soluble pouch, with the blending occurring either prior to loading or upon being loaded into the pouch. Thereafter, when its use is indicated, one or more pouches are dropped into the aqueous bath for preparing and/or replenishing the working solution for its intended purpose. Because of the sensitive nature of surface treating chemicals, it is desirable to reduce the episodes and frequency of contact between a worker and the ingredients. Indeed, because of the nature of certain cleaners and corrosion inhibitors, it is generally desirable to avoid and/or reduce skin contact, even though the components selected for use in the present invention are not considered dangerous.

The technique of the present invention is particularly useful in the cleaning stage where the removal of oil, lubricants, cutting fluids, metallic filings and dirt, and the like must be undertaken in order to prepare the metallic parts or components for further treatment or for in-plant storage and/or shipping to a further destination. In accordance with the present invention, selected corrosion inhibitors are added in the chemical formulations for baths or tanks used in metal cleaning or other component preparation operations. Water soluble bags for selected cleaner/corrosion inhibitor blends provides a system useful in maintaining proper processing environment without arbitrary and inaccurate forms of measurement. In addition to providing ease of handling, the bags provide additional safety with elimination of hand contact with chemicals, while at the same time eliminating container disposal problems. Also, the chemicals contained within the bag are all appropriately utilized, without the necessity of weighing operations which are frequently omitted or may not be conveniently available. The components making up the surface cleaner/corrosion inhibitor blends do not react with the water soluble bag, but at the same time, are readily and easily dispersed upon addition to the solutions held in the baths or tanks.

Therefore, it is a primary object of the present invention to provide an improved technique for cleaning and protecting surfaces of metallic components between successive manufacturing operations by cleaning the surfaces and protecting such surfaces against corrosion with a corrosion inhibitor, wherein the technique includes adding predetermined quantities of corrosion inhibitor and surface cleaners to an aqueous bath, with the components being retained within a water soluble container or pouch.

It is a further object of the present invention to package a selected surface cleaner and corrosion inhibitor within a water soluble bag, and thereafter preserving the bag and its contents until use, at which time the bag together with its contents is added directly to a treatment bath.

Other and further objects of the present invention will become apparent to those skilled in the art upon a study of the following specification and appended claims.

DESCRIPTION OF THE PREFERRED EMBODIMENT

In order to effectively practice the present invention, a powdered or liquid mix of surface cleaning and VCI chemical is selected for introduction into a water soluble pouch container, with the shelf life of the blend within the container being limited only by that of the PVA film container. In other words, the components must be selected such that they neither attack nor accelerate any deterioration of the PVA film comprising the container.

EXAMPLE I

A powder mix consisting of a blend of surface leaning agents and corrosion inhibitors was prepared in the following ratio:

| Component | Percent by Weight |
|---|---|
| Sodium Metasilicate | 40 |
| Tetrapotassium Pyrophosphate | 10 |
| Sodium Benzoate | 40 |
| Sodium Tolyltriazole | 10 |

The ratios as set forth above may be modified pursuant to the following workable ranges:

| Component | Percent by Weight |
|---|---|
| Sodium Metasilicate | 35–45 |
| Tetrapotassium Pyrophosphate | 5–15 |
| Sodium Benzoate | 35–45 |
| Sodium Tolyltriazole | 5–15. |

Following blending, the blend was packaged in a water soluble bag fabricated from polyvinylalcohol (PVA) film. Such bags are available from Aquafilm of Winston-Salem, NC under the trade designation "L" Series. These bags are prepared from polyvinylalcohol film and are soluble in cold water. The PVA bags can be protected from the environment by packaging in polyethylene bags until used.

A pouch containing five-pounds of the blend of Example I was added to a 100-gallon tank of water attached to a pressure washer, dissolved and circulated. This dispersion was effective in removing oil, grease, dirt, carbon build up or metal filings from metallic alloys. The added benefit of the indoor corrosion protection of the metallic components for up to six months is especially useful in large manufacturing operations where parts are held in inventory.

The sodium metasilicate functions as a detergent base, with the tetrapotassium pyrophosphate functioning as a detergent builder. The combination of sodium benzoate and sodium tolyltriazole function as an excellent corrosion inhibitor in this formulation.

EXAMPLE II

A powder mix was prepared from the following chemical and bagged in five-pound lots in water soluble bags as in Example I, in the following composition:

| Component | Percent by Weight |
|---|---|
| Sodium Metasilicate | 40 |
| Tetrapotassium Pyrophosphate | 10 |
| Sodium Sulfonate | 10 |
| Benzotriazole | 10 |
| Sodium Benzoate | 30. |

suitable working solutions may be prepared from the components of Example II in the following workable ranges:

| Component | Percent by Weight |
|---|---|
| Sodium Metasilicate | 35–40 |
| Tetrapotassium Pyrophosphate | 5–10 |
| Sodium Sulfonate | 5–10 |
| Benzotriazole | 5–10 |
| Sodium Benzoate | 20–35. |

Two five-pound bags of the composition of Example II were added to a 100-gallon dip tank that is used for removing oil, grease, and the like from metallic articles. This composition was especially useful for the cleaning of magnesium articles and leaving a corrosion resistant surface. The added benefit of indoor corrosion protection for up to six months is especially useful in large manufacturing plants where parts are held in inventory.

The composition of Example II differs from that of Example I in that it contains a quantity of sodium sulfonate. This component is utilized in the mix or blend as an additional detergent component, corrosion inhibitor, wetting agent, and is useful within the ranges indicated.

EXAMPLE III

A powder mix was prepared in accordance with the following composition and bagged in five-pound lots in water soluble bags:

| Component | Parts by Weight |
|---|---|
| Sulfamic acid | 53 |
| Ammonium citrate | 46 |
| Sodium sulfate | .05 |
| Sodium iodide | 0.5 |
| Polyxyethylene sorbitan monoleate | .051 |
| Benzotriazole | 0.5. |

Suitable formulations from the components of this Example III may be prepared in accordance with the following compositions:

| Component | Percentage Range by Weight |
|---|---|
| Sulfamic acid | 45–55 |
| Ammonium citrate | 45–50 |
| Sodium sulfate | .03–.05 |
| Sodium iodide | .3–.5 |
| Polyxyethylene sorbitan monoleate | .051 |
| Benzotriazole | .3–.5. |

Two five-pound bags of the composition of Example III hereinabove were added to 100-gallons of water in an ultrasonic bath which was effective in removing the oxide from stainless steel, other ferrous metals and staining on yellow metals such as copper and brass. Depending on the extent of soil or oil build up and extent of oxide formation, the bath will be effective in cycles up to one hour and the solution will not be aggressive to the metallic surfaces after oxide removal. After removal from the bath, the metallic surfaces are neutralized in working solutions consistent with Examples I or II hereinabove in a quick wash cycle. Both of these products will leave corrosion inhibitor surfaces on the metals, which is especially useful for storage.

EXAMPLE IV

A liquid mixture that was extremely useful in removing grease and oil residue was prepared from the following chemicals and packaged in the polyvinylalcohol bags:

| Component | Parts by Weight |
|---|---|
| D-Limonene | 50 |
| Modified coconut oil diethanolamide | 47 |
| Benzotriazole | 1 |
| Monoethanolamine | 2. |

Suitable formulations from the components of this Example IV may be prepared in accordance with the following compositions:

| Component | Parts by Weight |
|---|---|
| D-Limonene | 50–55 |
| Modified coconut oil diethanolamide | 45–55 |
| Benzotriazole | .5–1.0 |
| Monoethanolamine | 1–3. |

Bags containing the composition of this Example IV can be added directly to dipping tanks where the contents are effectively dispersed and the bags dissolved. This dispersion does an effective cleaning operation and leaves a corrosion protective surface on the metal. The use of the polyvinylalcohol bags with selected liquid chemicals provides a safe and efficient process for adding an exact amount into a dipping tank without container or hand contact.

By way of further example, the components of Example IV may be utilized in a composition within the following ranges:

| Component | Parts by Weight |
|---|---|
| D-Limonene | 50–55 |
| Modified coconut oil diethanolamide | 45–55 |
| Benzotriazole | .5–1.0 |
| Monoethanolamine | 1–3. |

In connection with the composition of this Example IV, the D-limonene typically functions as a cleaning agent, with the coconut oil diethanolamide being utilized as a detergent component. The benzotriazole and monoethanolamine are corrosion inhibitors, with the monoethanolamine component having the added property and utility of an emulsifying and detergent component.

It will be appreciated that the above specific examples are for purposes of illustration and are not intended to be a limitation upon the scope of the present invention.

What is claimed is:

1. A method of cleaning a surface of a metallic article and applying a corrosion inhibiting film thereto which includes subjecting the metallic article to an aqueous metal treatment bath, wherein said method comprises the steps of;

(a) providing a surface cleaner detergent selected from the group consisting of sodium metasilicate and tetrapotassium pyrophosphate;

(b) providing a corrosion inhibitor selected from the group consisting of sodium benzoate, sodium tolyltriazole, and benzotriazole;

(c) blending said surface cleaner detergent and said corrosion inhibitor to form a powdered mixture;

(d) loading said powdered mixture into a retainer pouch consisting of a water soluble polyvinylalcohol film;

(e) placing said retainer pouch into an aqueous metal treatment bath;

(f) dispersing and dissolving said powdered mixture of said surface cleaner detergent and said corrosion inhibitor into said aqueous metal treatment bath; and (g) cleaning said surface of said metallic article and applying a corrosion inhibiting film to said surface of said metallic article by immersing said metallic article into said aqueous metal treatment bath containing said surface cleaner detergent and said corrosion inhibitor.

2. A method of cleaning the surface of a metallic article and applying a corrosion inhibiting film thereto which includes subjecting the metallic article to an aqueous metal treatment bath, wherein said method comprises the steps of:

(a) providing a surface cleaner detergent consisting of sodium sulfonate;

(b) providing a corrosion inhibitor selected from the group consisting of sodium benzoate and benzotriazole;

(c) blending said surface cleaner detergent and said corrosion inhibitor to form a powdered mixture;

(d) loading said powdered mixture into a retainer pouch consisting of a water soluble polyvinylalcohol film;

(e) placing said retainer pouch into an aqueous metal treatment bath;

(f) dispersing and dissolving said powdered mixture of said surface cleaner detergent and said corrosion inhibitor into said aqueous metal treatment bath; and (g) cleaning said surface of said metallic article and applying a corrosion inhibiting film to said surface of said metallic article by immersing said metallic article into said aqueous metal treatment bath containing said surface cleaner detergent and said corrosion inhibitor.

* * * * *